United States Patent [19]

Lytle et al.

[11] Patent Number: 5,033,896

[45] Date of Patent: Jul. 23, 1991

[54] INDICATING CHART PEN CARTRIDGE WITH TRANSPARENT WALL

[75] Inventors: William F. Lytle, Woodbridge; Michael Mathews, Monroe, both of Conn.

[73] Assignee: Waterbury Pen Corporation, West Haven, Conn.

[21] Appl. No.: 117,549

[22] Filed: Nov. 6, 1987

[51] Int. Cl.[5] ..... B43K 8/02; B43K 8/06

[52] U.S. Cl. ..... 401/192; 346/140 A; 401/199; 401/194

[58] Field of Search ..... 401/194, 192, 199; 346/140 R, 140 A

[56] References Cited

U.S. PATENT DOCUMENTS

| | | | |
|---|---|---|---|
| 2,678,633 | 5/1954 | Holden et al. | 401/192 |
| 3,934,255 | 1/1976 | Taylor | 346/140 A |
| 4,100,549 | 7/1978 | Hubbard | 346/140 A |

FOREIGN PATENT DOCUMENTS

| | | | |
|---|---|---|---|
| 2738079 | 3/1979 | Fed. Rep. of Germany | 346/140 A |
| 0006110 | 1/1981 | Japan | 346/140 A |

*Primary Examiner*—Steven A. Bratlie

*Attorney, Agent, or Firm*—H. Gibner Lehmann; K. Gibner Lehmann

[57] ABSTRACT

A cartridge consisting of a hollow casing of molded plastic substance and an ink-retention sponge disposed in the casing, together with a stylus carried by the casing, for producing ink lines on a chart, from the ink content of the casing and contained retention sponge. A wall of the casing is transparent to enable the retention sponge therein and the ink carried thereby to be viewed by a user from the exterior of the casing. The intensity of the observed ink color is an indication as to the amount of ink remaining in the casing and sponge.

3 Claims, 1 Drawing Sheet

INDICATING CHART PEN CARTRIDGE WITH TRANSPARENT WALL

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

Field of the Invention

This invention relates to replacement ink cartridges for chart recorders and the like, and more particularly to pen cartridges for such recorders.

DESCRIPTION OF THE RELATED ART INCLUDING INFORMATION DISCLOSED UNDER 37 CFR §§1.97-1.99.

Heretofore it has been the common practice to fabricate chart pen cartridges as a plastic molding, of ink-insoluble plastic substance such as polypropylene or the like, these being opaque and selected as to color according to various factors involving sales, eye appeal, color of the ink content, etc. It was not possible to readily ascertain the degree of emptyness or depletion of the ink in the reservoir of such cartridges, and this was a distinct disadvantage at times, from the standpoint of the chartist or user.

SUMMARY OF THE INVENTION

The above disadvantage and drawback of prior chart pen cartridges is obviated by the present invention, and one object of the invention is to provide an improved chart pen cartridge which is so constituted that the ink content thereof, or lack of content thereof, can be quickly and readily ascertained after a period of use, and wherein the indication is relatively large in expanse and easily viewed while the cartridge is in use.

Another object of the invention is to provide an improved chart pen cartridge as above set forth, which is especially simple in its construction and economical to fabricate.

A further object of the invention is to provide an improved chart pen cartridge in accordance with the foregoing, which does not require extensive changes as compared with existing cartridges, to effect the desired indication as to ink content.

Yet another object of the invention is to provide an improved chart pen cartridge as characterized above, which does not require retooling in order to obtain the indication.

A further object of the invention is to provide an improved indicating-type cartridge as set forth, which is reliable as to its functioning and not susceptible to leakage any more than conventional cartridges.

A still further object of the invention is to provide an improved indicating cartridge, which immediately apprises the user or prospective user or chartist of the color of the ink content.

An additional object of the invention is to provide an improved indicating-type chart pen cartridge, wherein color intensity is utilized to give the indication as to the ink content remaining in the cartridge reservoir.

Still other features and advantages will hereinafter appear.

In accomplishing the above objects the invention provides an indicating-type chart pen cartridge consisting of a hollow casing of molded plastic substance and an ink-retention sponge disposed in said casing, together with stylus means carried by the casing, for producing ink lines on a chart, from the ink content of said casing and contained retention sponge. A wall of the casing is transparent to enable the retention sponge therein and the ink carried thereby to be viewed by a user from the exterior of the casing. The intensity of the observed ink color is an indication as to the amount of ink remaining in the casing and sponge.

DESCRIPTION OF THE PREFERRED EMBODIMENT

Figure 1:
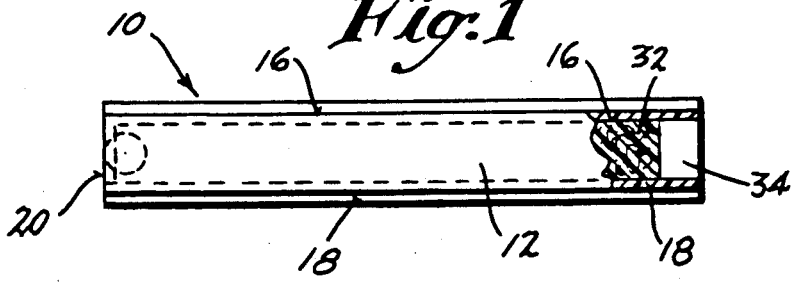
FIG. 1 is a view, partly in top plan view and partly in horizontal section, of an improved chart pen cartridge as provided by the invention. The section is taken on the line 1—1 of FIG. 2.
Figure 2:
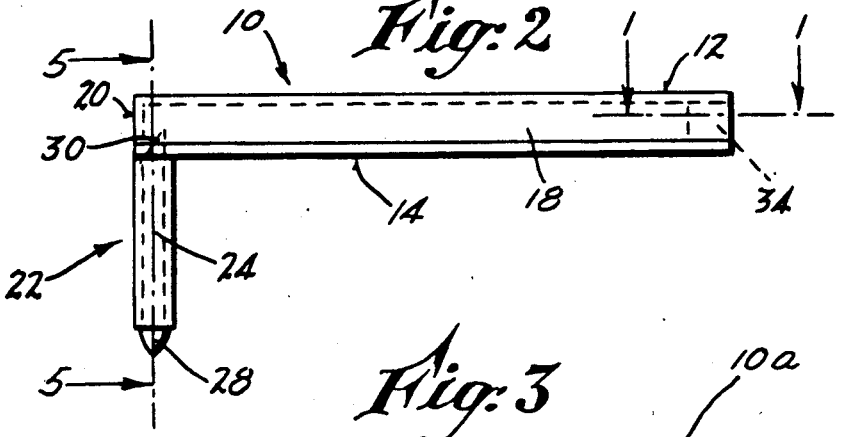
FIG. 2 is a side elevational view of the cartridge of FIG. 1.

Referring to the figures, the cartridge comprises a casing 10 which is preferably molded in one piece of plastic substance such as polypropylene. The casing 10 has a top wall 12, a bottom wall 14, side walls 16 and 18, and an end wall 20, preferably all integral with each other.

Depending from the bottom wall 14 is a stylus construction designated generally by the numeral 22, comprising a hollow, elongate tubular boss 24 which is also integral with the wall 14.

Contained in the boss 24 is a stylus member 26 of fibrous make-up, having a writing tip 28 at its outer end, and having a sloped or angled inner end 30 adapted as an intake for ink contained in the casing 10.

Figure 5:
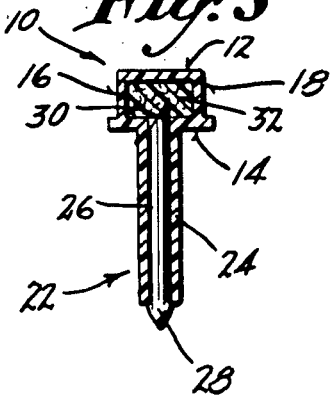
FIG. 5 is a section taken on the line 5—5 of FIG. 2.

In the casing 10 there is a sponge or ink reservoir member 32 which is preferably also of fibrous make-up and constituted of felt, or plastic substance such as acetate or polyester material. As seen in FIG. 5, the sloped end 30 of the stylus member 26 is imbedded in the sponge member 32, thereby to establish a good path for ink flow from the sponge member to the stylus member.

The casing has an end or back plug 34 which is applied after the filling of ink into the casing, for the purpose of sealing the latter.

In accordance with the invention for the purpose of providing an indication of the extent of emptying of ink from the casing 10, one or more of the walls, and preferably at least the top wall 12 thereof is made transparent to enable the sponge 32 and the ink which permeates it, to be viewed from the exterior of the casing. Conveniently, the entire casing 10 can be molded of a transparent plastic substance, in order to effect this. Also, as provided by the invention, the sponge member 32 is constituted of a light-colored material, and preferably of a white material such as plastic.

Figure 3:
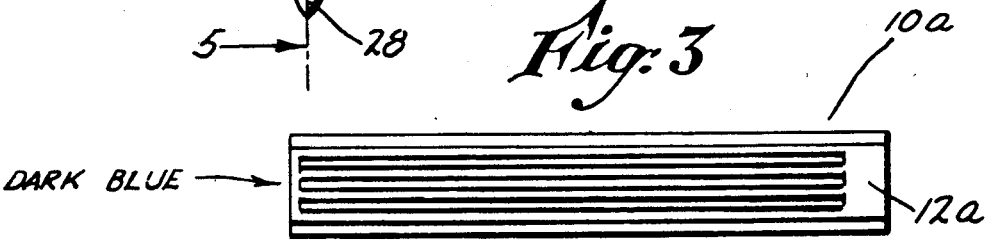
FIG. 3 is a diagrammatic representation of the top of a newly-filled cartridge, indicating the colored appearance as made possible by the transparent top wall.
Figure 4:
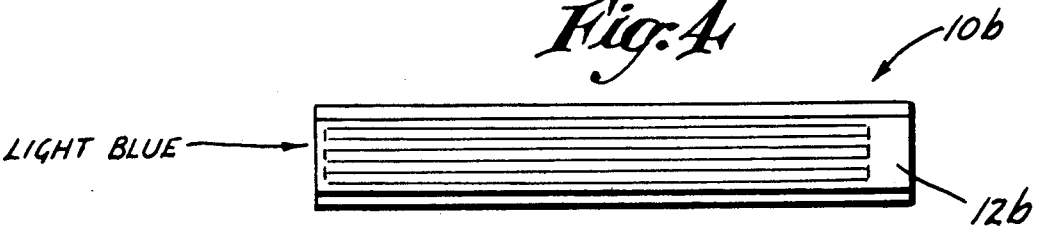
FIG. 4 is a diagrammatic representation similar to that of FIG. 3 but indicating the appearance of the cartridge after the ink content thereof has been mostly depleted by use.

By such organization, a useful effect and function is had with the improved cartridge of the invention. As illustrated diagrammatically in FIGS. 3 and 4, a chartist or user of the cartridge can readily determine at a glance the amount of ink which remains in the casing 10. If the user observes a deep color, such as a dark blue appearance of the top wall 12*a* of the casing 10*a* indicated in FIG. 3, this will apprise him or her that the cartridge still has a good supply of ink and still can be used for an appreciable time. If the color of blue which is observed is very light, as of the top wall 12*b* of the casing 10*b* illustrated in FIG. 4, this will indicate that the ink supply is mostly depleted. Various light and dark shades of coloring in between the light and dark values, give an indication of lesser or greater amounts of ink still available.

We have found that by making the sponge member 32 of white or light material or substance, a better reading of the colors is had since the lightest will be nearest the "no-color" end of the range to be observed.

The cartridge of the invention provides a distinct advantage to the user, in that at any time it is possible to know how much ink is still available in the casing, for use. Thus there is minimized the possibility that the ink supply would become unexpectedly depleted during an important, lengthy test run employing a chart recorder; loss of test data due to depletion of the cartridge is thus essentially completely obviated.

Also, such indication is reliable, easily seen since it is relatively large in expanse, and does not increase the cost of the product. No tool changes are required, nor any revision of manufacturing procedures, as can be understood. Mounting structures similar to those on conventional cartridges can be employed on the cartridge of the invention, thereby maintaining complete interchangeability of the new cartridge with older, existing cartridge designs.

While the invention has been illustrated in connection with blue ink, it will be understood that it has utility with other color inks, such as red or black, etc.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

We claim:

1. An indicating-type chart pen cartridge comprising, in combination:

(a) a hollow casing of molded plastic substance, (b) an ink-retention sponge disposed in said casing, said ink-retention sponge containing ink having a color selected from the group consisting of red, blue and black, and (c) stylus means carried by the casing, for producing ink lines on a chart, from the ink content of said casing and contained retention sponge, (d) a wall of said casing being transparent to enable the retention sponge therein and the ink carried thereby to be viewed by a user from the exterior of the casing, (e) said ink-retention sponge being constituted of light-colored plastic substance which provides a distinct contrast with respect to the color of the ink so as to more clearly indicate either a saturated or a depleted condition of said sponge, (f) said ink-retention sponge being fibrous.

2. The invention as set forth in claim 1, wherein:

(a) the ink-retention sponge comprises acetate.

3. The invention as set forth in claim 1, wherein:

(a) the ink-retention sponge comprises polyester.

* * * * *